United States Patent [19]

Culver

[11] 4,347,692

[45] Sep. 7, 1982

[54] PORTABLE DRILLING RIG

[76] Inventor: Robert B. Culver, P.O. Box 1234, Claresholm, Alberta, Canada, T0L 0T0

[21] Appl. No.: 180,916

[22] Filed: Aug. 25, 1980

[51] Int. Cl.[3] ..... E04H 12/34; E21C 9/00

[52] U.S. Cl. ..... 52/117; 52/121; 173/28; 173/43

[58] Field of Search ..... 52/116, 117, 118, 119, 52/121; 173/28, 43; 182/2, 63, 102, 103

[56] References Cited

U.S. PATENT DOCUMENTS

| | | | |
|---|---|---|---|
| 298,625 | 5/1884 | Saunders | 52/116 |
| 2,954,210 | 9/1960 | Comfort | 173/28 |
| 3,089,550 | 5/1963 | Watson | 173/28 |
| 3,144,135 | 8/1964 | Brown | 173/28 |
| 3,340,938 | 9/1967 | Wilson | 173/28 |
| 3,356,163 | 12/1967 | Rowe | 173/43 |
| 3,412,812 | 11/1968 | Kindsfater | 173/43 |
| 3,576,218 | 4/1971 | Lisenby | 173/43 |
| 3,645,343 | 2/1972 | Mays | 173/28 |
| 3,877,528 | 4/1975 | Reierdal | 173/43 |

*Primary Examiner*—Reinaldo P. Machado
*Attorney, Agent, or Firm*—George H. Dunsmuir

[57] ABSTRACT

A portable drilling rig for mounting on a flatbed truck or other carrier vehicle, includes a turntable rotatably mounted on the truck bed; a slide pivotally mounted on the top of the turntable for rotation around a horizontal axis; a hydraulic cylinder interconnecting the turntable and slide for raising and lowering one end of the slide so that the slide can be tilted from a transport position to an operating position beside the truck; a carriage slidably mounted on the slide, the position of the carrier on the slide being controlled by a winch, pulley and cable system; a derrick pivotally mounted on the carriage for rotation between the transport and operating positions, and a hydraulic cylinder interconnecting the carriage and the derrick for causing the derrick to move between the transport and operating positions.

6 Claims, 5 Drawing Figures

PORTABLE DRILLING RIG

BACKGROUND OF THE INVENTION

This invention relates to a portable drilling rig, and in particular to a drilling rig of the type which is adapted to be mounted on a truck or similar vehicle.

The prior art discloses many vehicle supported drilling rigs. Such rigs are disclosed, inter alia, by U.S. Pat. Nos. 2,817,495, issued to E. J. Pearl on Dec. 24, 1957; 2,954,210, issued to H. W. Comfort on Sept. 27, 1960; 3,089,550, issued to J. V. Watson on May 14, 1963; 3,144,135, issued to H. D. Brown on Aug. 11, 1964; 3,340,938, issued to J. H. Wilson on Sept. 12, 1967; 3,576,218, issued to E. J. Lesenby on Apr. 27, 1971 and 3,645,343, issued to G. E. Mays on Feb. 29, 1972. Many of the drilling rigs disclosed by such art are large, heavy machines intended for use on level ground. In fact, many of the vehicles or rigs are equipped with levelling devices for ensuring that the rig-supporting structure is maintained in a horizontal plane. It is readily apparent from a review of such art that a need exists for an uncomplicated portable drilling rig which can be used on smooth or rough terrain.

The object of the present invention is to provide a relatively simple portable drilling rig which can be used in drilling operations remote from a carrier vehicle, e.g. roadside drilling in which the vehicle remains on the road and drilling occurs in a ditch or other location at the side of the road.

SUMMARY OF THE INVENTION

Accordingly, the present invention relates to a portable drilling rig for mounting on a carrier vehicle comprising a turntable adapted to be rotatably mounted on the vehicle for rotation around a vertical axis; slide means pivotally mounted on said turntable for rotation around a horizontal axis; carriage means slidably mounted on said slide means for sliding movement therealong between retracted and extended positions; a drilling derrick mounted on said carriage means for movement with said carriage means between the retracted and extended positions; elevating means for raising and lowering one end of said slide means; means pivotally connecting the one end of said derrick to the one end of said carriage means; and lifting means for raising the other end of said derrick from said carriage means to orient the derrick with the longitudinal axis thereof in the vertical, whereby actuation of said elevating means raises said one end of said slide means from a transport position on and in alignment with said carrier vehicle, rotation of said turntable moves said slide means, carriage means and derrick out of alignment with said carrier vehicle to an operating position where said one end of the slide means can be lowered by said elevating means to ground level, sliding of said carriage means along said slide means moves said one end of said carriage means into engagement with the ground, and actuation of said lift means elevates the other end of said derrick to place the derrick in the operating position.

BRIEF DESCRIPTION OF THE DRAWINGS

The invention will now be described in greater detail with reference to the accompanying drawings which illustrate a preferred embodiment of the invention, and wherein.

DESCRIPTION OF THE PREFERRED EMBODIMENT

Figure 1:
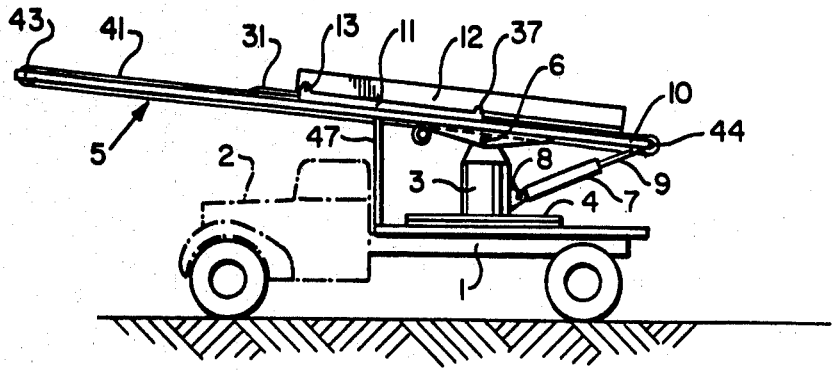
FIG. 1 is a schematic side view of a truck with a portable drilling rig in accordance with the present invention mounted thereon.
Figure 2:
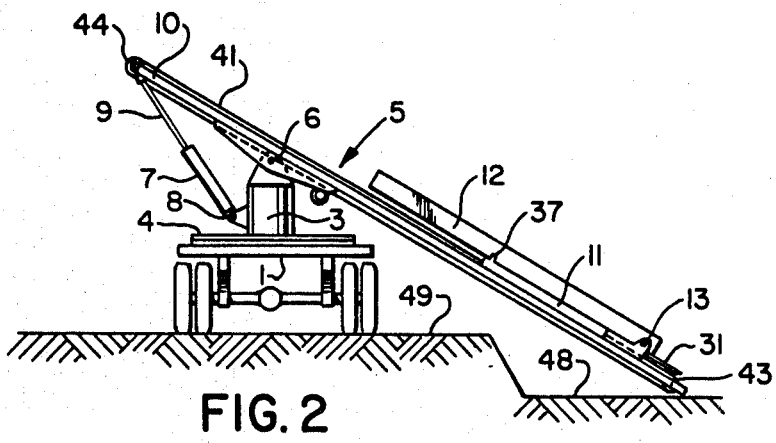
FIGS. 2 and 3 are schematic end views of the truck and drilling rig of FIG. 1, the two figures showing the derrick portion of the rig in two positions.
Figure 3:
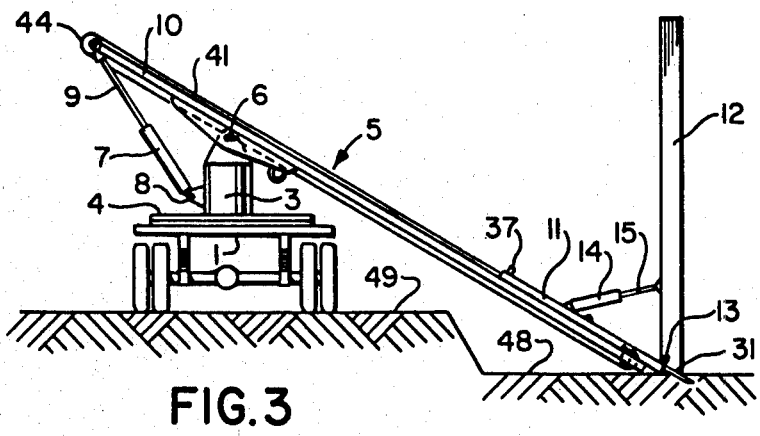

With reference to FIGS. 1 to 3, the rig of the present invention is intended to be mounted on a bed 1 of a flatbed truck 2. The basic elements of the rig include a turntable 3 mounted for rotation on a base 4 on the bed of the truck 2. A slide generally indicated at 5 is pivotally mounted on the turntable 3 for rotation about a horizontal axis defined by a shaft 6 connecting the slide to the top end of the turntable. The inclination of the slide 5 is controlled by elevating means in the form of a hydraulic cylinder 7 which is pivotally connected to the turntable 3 by a pin 8. The outer end of a piston rod 9 projecting out of the cylinder 7 is pivotally connected to one end 10 of the slide 5. A carriage 11 is slidably mounted on the slide 5 for movement between a retracted position (FIG. 1) and an extended position (FIG. 3). A derrick 12 is pivotally mounted on the carriage 11 for rotation about a horizontal axis defined by a shaft 13 for movement between a rest or transport position (FIG. 1) and an erect position (FIG. 3). The derrick 12 is moved from the rest to the erect position by lifting means in the form of a hydraulic cylinder 14 (FIG. 3) which is pivotally mounted on the carriage 11. Piston rod 15 of the cylinder 14 is pivotally connected to the derrick 12 close to one end thereof (the bottom end when the derrick is in the erect position.)

Figure 4:
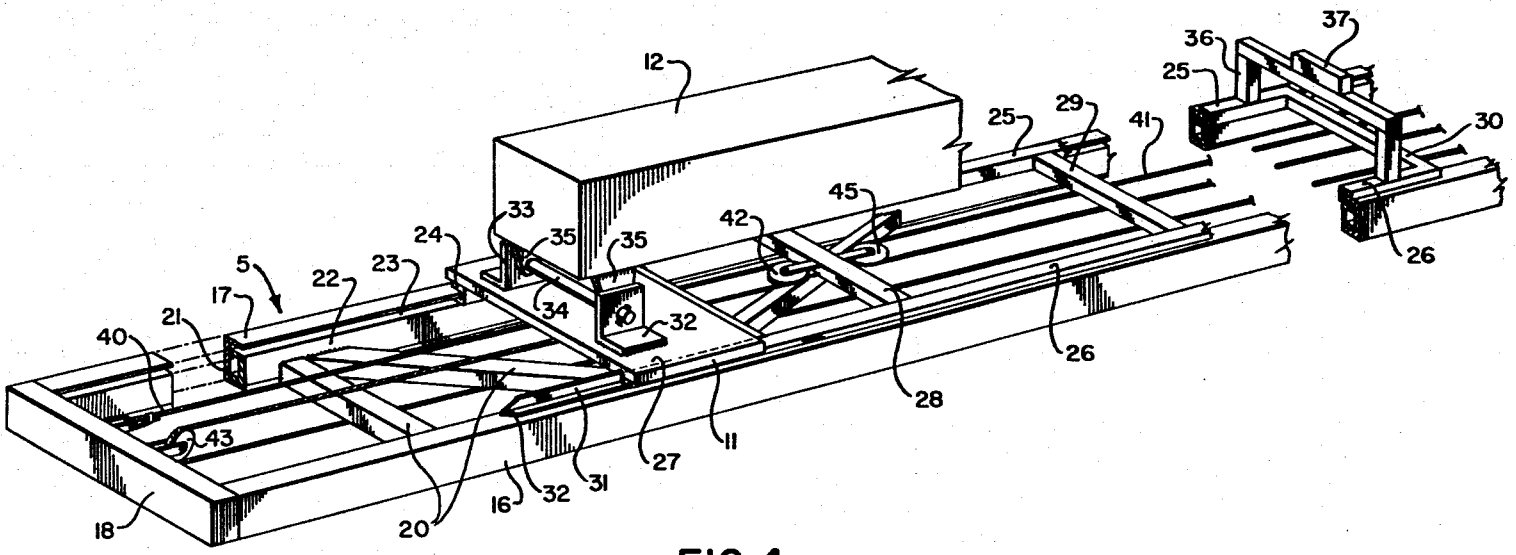
FIG. 4 is a partly sectioned, schematic perspective view of the outer end of the slide, carriage and derrick portions of the rig of FIGS. 1 to 3.
Figure 5:
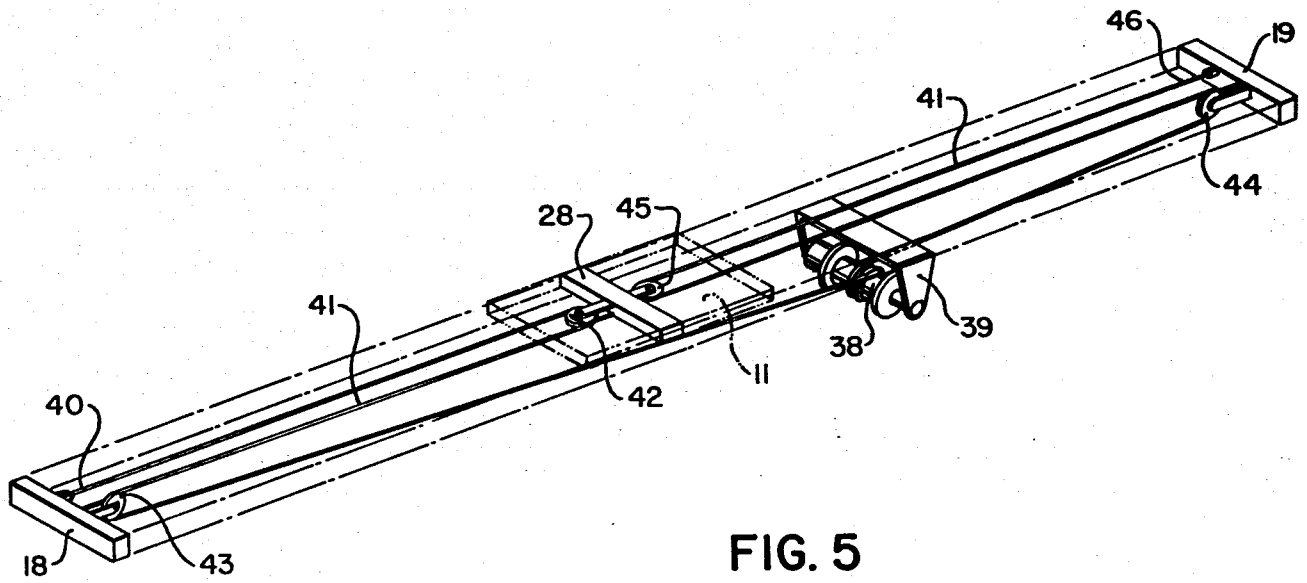
FIG. 5 is a schematic perspective view of the slide carriage and a winch of the rig of FIGS. 1 to 4.

Referring to FIGS. 4 and 5, the slide 5 mounted on the turntable 3 is in the form of a rectangular frame with sides 16 and 17, ends 18 and 19, and cross-braces 20. Each of the sides 16 and 17 includes a pair of opposed generally C-shaped channel members 21 and 22, which are interconnected along their lengths. The smaller channel member 22 is nested in the bight of the larger number 21, leaving a gap 23 at the top of the side for receiving the bottom side of a C-shaped channel element 24 on the bottom of the carriage 11.

The carriage 11 (FIG. 4) includes a pair of sides 25 and 26, interconnected at one end by a plate 27, by cross-braces 28 and 29 and, at the other end by a bar 30. A rod 31 in the form of a length of angle iron with a pointed outer end 32 is connected to the plate end of the side 26 of the carriage 11. The purpose of the rod 31 is described hereinafter in the description of the operation of the rig. L-shaped flanges 32 and 33 are welded to the plate 27 for supporting a shaft 34. The shaft 34 extends through a pair of downwardly extending flanges 35 on the derrick 12 between the flanges 32 and 33 for pivotally supporting the derrick for rotation around the shaft 34. The hydraulic cylinder 14 (not shown in FIGS. 4 and 5) is pivotally mounted on cross-brace 29. An inverted U-shaped bridge 36 is provided at the other end of the carriage 11 with a block 37 on the top centre thereof for supporting the derrick 12 at its middle.

With specific reference to FIG. 5, the carriage 11 and derrick 12 are moved along the slide 5 by means of drive in the form of a winch 38 and an associated pulley system. The winch 38 is mounted on a bracket 39 on the bottom of the slide 5 near the centre thereof. One end 40 of a wire cable 41 is fastened to one end 18 of the slide 5. The cable 41 passes around a pulley 42 on one side of the cross-brace 28 of the carriage 11, around a pulley 43 on such one end 18 of the slide, around the winch 38, around a pulley 44 on the other end 19 of the slide 5 and around a pulley 45 on the other side of the cross-brace 28. The other end 46 of the wire cable is fastened to the other end 19 of the slide 11.

For the sake of simplicity, the rig of the present invention has been illustrated schematically with parts omitted from each of the drawings. In practice the slide is constructed with a cradle for carrying the sections of a drill string, and the derrick is provided with stabilizing feet. These and other extras are not illustrated or described since they do not form part of the invention.

OPERATION

In operation, the rig is normally mounted on the truck 2 in the manner illustrated in FIG. 1, i.e. in the transport position with the carriage 11 in the retracted position, and the slide 5 resting on a support wall 47 at the front of the truck bed 1.

Upon reaching a drilling location, e.g. when it is desired to drill in a ditch 48 at the side of a road 49 (FIGS. 2 and 3), the cylinder 7 is actuated to retract the piston rod 9 which raises the front end of the slide 5, and the carriage 11 and derrick 12. The turntable 3 is rotated to the position illustrated in FIG. 2 so that the slide 5, carriage 11 and derrick 12 are perpendicular to the road 49 and the ditch 48. The cylinder 7 is actuated to extend the piston rod 9 which elevates the end 10 of the slide 5, lowering the other end thereof until the slide engages the ground near the drilling location. The winch 38 is actuated, i.e. rotated clockwise (FIG. 5) to move the slide 5 downwardly until the rod 31 penetrates the ground thus stabilizing the carriage 11 and derrick 12 in one position.

With the slide 5, carriage 11 and derrick 12 in position, the cylinder 14 is actuated to extend the piston rod 15 which raises the derrick 12 to the drilling position (FIG. 3). Upon completion of the drilling operations, the sequence of steps described above is reversed to return the slide 5, carriage 11 and derrick 12 to the rest or transport position (FIG. 1).

While the rig has been described for use in a ditch at the side of a road, it will be appreciated that the rig can be utilized on level terrain and in off-the-road drilling operations.

Of course, the hydraulic cylinders referred to hereinbefore can be replaced with pneumatic cylinders or other means for raising and lowering the various movable elements. The type of drive for the turntable is optional.

What I claim is:

1. A portable drilling rig for mounting on a carrier vehicle comprising a turntable rotatably mounted on the vehicle for rotation therein around a vertical axis; slide means pivotally mounted on said turntable for rotation around a horizontal axis; carriage means slidably mounted on said slide means for sliding movement therealong between retracted and extended positions; a drilling derrick mounted on said carriage means for movement with said carriage means between the retracted and extended positions; elevating means for raising and lowering one end of said slide means; means pivotally connecting said derrick to said carriage means; and lifting means for raising the other end of said derrick from said carriage means to orient the derrick with the longitudinal axis thereof in the vertical, whereby actuation of said elevating means raises said one end of said slide means from a transporting position on and in alignment with said carrier vehicle, rotation of said turntable moves said slide means, carriage means and derrick out of alignment with said carrier vehicle to an operating position where said one end of the slide means can be lowered by said elevating means to ground level, sliding of said carriage means along said slide means moves said one end of said carriage means into engagement with the ground, and actuation of said lift means elevates the other end of said derrick to place the derrick in the operating position.

2. A drilling rig according to claim 1, wherein said slide means includes a pair of sides defining tracks, and said carriage means includes channel elements for slidably engaging said sides.

3. A drilling rig according to claim 1, wherein said elevating means includes cylinder means pivotally connected to said turntable, and a piston rod extending out of said cylinder means and having an outer end pivotally connected to said slide means.

4. A drilling rig according to claim 1, wherein said lift means includes a cylinder pivotally connected to said carriage means, and a piston rod extending out of said cylinder and having an outer end pivotally connected to said derrick.

5. A drilling rig according to claim 1, including drive means for moving said carriage means and derrick between the retracted and extended positions, said drive means including a winch on said slide means, pulley means on said slide means and carriage means, and cable means connected to said slide means and passing around said winch and pulley means.

6. A drilling rig according to claim 1, including pointed rod means on said one end of said carriage means for penetrating the ground and locking the carriage means, slide means and derrick in position at a drilling location.

* * * * *